United States Patent [19]

Syracuse et al.

[11] Patent Number: 4,770,797

[45] Date of Patent: Sep. 13, 1988

[54] CARBON FLUORIDE CHLORIDE LUBRICANT

[75] Inventors: Allan V. Syracuse, Clarence; Lynn E. McCurry, Hamburg; David Nalewajek, West Seneca, all of N.Y.

[73] Assignee: Allied-Signal Inc., Morris Township, Morris County, N.J.

[21] Appl. No.: 846,547

[22] Filed: Mar. 31, 1986

[51] Int. Cl.[4] ..... C10M 125/02; C10M 125/18

[52] U.S. Cl. ..... 252/12; 252/58; 570/125; 570/134

[58] Field of Search ..... 252/12, 58; 570/125, 570/134

[56] References Cited

U.S. PATENT DOCUMENTS

| | | | |
|---|---|---|---|
| 2,411,159 | 11/1946 | Hanford | 570/134 |
| 2,533,425 | 12/1950 | Carnell | 570/134 |
| 2,554,857 | 5/1951 | Gochenour | 570/134 |
| 2,786,874 | 3/1957 | Teeters et al. | 260/653 |
| 2,993,567 | 7/1961 | Schachmer | 184/1.0 |
| 3,607,747 | 9/1971 | Ishikawa et al. | 252/18 |
| 3,717,576 | 2/1973 | Hiratsuka et al. | 252/12 |
| 3,756,925 | 9/1973 | Takourhi et al. | 252/12.2 |
| 3,776,845 | 12/1973 | Watanabe et al. | 252/12 |
| 3,892,590 | 7/1975 | Gunther | 136/83 R |
| 3,988,137 | 10/1976 | Goodwin | 252/29 |
| 4,165,974 | 8/1979 | Goodwin et al. | 252/58 |
| 4,247,608 | 1/1981 | Wantanabe et al. | 429/194 |
| 4,324,930 | 4/1982 | von Halasz | 570/134 |
| 4,354,948 | 10/1982 | Schoch et al. | 252/22 |
| 4,525,287 | 6/1985 | Carstensen | 252/26 |

FOREIGN PATENT DOCUMENTS

| | | | |
|---|---|---|---|
| 356726 | 10/1961 | Switzerland | 33/165 |
| 759,173 | 10/1956 | United Kingdom . | |

OTHER PUBLICATIONS

Fluoropolymer Solid Lubricants, Arkles and Peterson, Polym. Sci. Technol., 1974, 453–467.

*Primary Examiner*—William R. Dixon, Jr.
*Assistant Examiner*—Ellen McAvoy
*Attorney, Agent, or Firm*—Jay P. Friedenson

[57] ABSTRACT

The application of carbon fluoride chloride in dry lubricant compositions is disclosed. The material offers a substantial improvement in lubricating properties over prior art carbon fluoride dry lubricants.

The improved lubricant is comprised of carbon fluoride chloride of the general formula $(C_yF_xCl_z)_n$ wherein y is 1 or 2, x is greater than 0 to 1.2, z is 0.1 and n defines an infinitely large two dimensional array of repeating units occurring in this molecule of high molecular weight. The resulting lubricant has improved lubricating properties over graphite, $MoS_2$ and carbon monofluoride.

11 Claims, No Drawings

CARBON FLUORIDE CHLORIDE LUBRICANT

DESCRIPTION

This invention relates to a novel lubricant composition and more particularly to a carbon fluoride chloride of the general formula $(C_yF_xCL_z)_n$ wherein y is from 1 to 2, x is greater than 0 to 1.2, z is 0.1 and n defines an infinitely large two dimensional array of repeating units occurring in this molecule of high molecular weight. The lubricant of the invention has substantially improved lubricating properties over graphite, $MoS_2$ and carbon monofluoride.

BACKGROUND OF THE INVENTION

In the prior art carbon fluoride compounds of the type $C_1F_1$ for use as dry lubricants are known. Considerable interest has centered on lubricating systems which employ materials of this kind. As an example of such systems, U.S. Pat. No. 2,993,567 discloses the application of graphite fluoride to metal, metal alloys, plastic materials, glass, etc., by dusting a part of or all of the surfaces subjected to friction. In U.S. Pat. No. 3,988,137 the use of carbon fluoride as a lubricant in glass forming molds is disclosed, wherein the lubricant is deposited by vaporizing a metered quantity of a suspension of dry lubricant on the mold's surface and prevented the sticking of the glass object to the mold upon cooling. In an improvement on this procedure, U.S. Pat. No. 4,165,974 describes the use of carbon monofluoride as a permanent lubricant on the mold for shaping molten glass gob by burnishing with a cotton cloth or wire brushing it into the metal.

In U.S. Pat. No. 3,717,576 a method of making a composite bearing which comprises mixing and molding a synthetic resin, graphite fluoride of molar ratio C:F=1:1, and a third component. U.S. Pat. No. 3,776,845 also describes the dispersion of graphite fluoride and a conventional lubricating material in a synthetic resin for paint. The paint is applied to a mechanical device having bearings and sliding parts. The dry film of the coating composition acts as a durable solid lubricant.

In U.S. Pat. No. 4,354,948 the mixing of graphite fluoride in glycerine with a separately prepared aqueous dispersion of graphite fluoride stabilized by a salt of a condensate of naphthalene sulfonic acid with formol to form a lubricating varnish for metals is disclosed.

Although various dry lubricants are acknowledged as being known in the prior art, there is a need for improved composition of this kind.

SUMMARY OF THE INVENTION

In accordance with the invention, we have discovered a superior lubricant; the lubricating properties of carbon fluoride chloride, $(C_yF_xCl_z)_n$ as described herein affords a substantially improved functional composition. We have found in accordance with the invention that the composition herein provided offers substantial improvements in lubricating properties over prior art carbon fluoride when used as a dry lubricant.

The novel dry lubricant of the invention comprises a carbon fluoride chloride, $(C_yF_xCl_z)_n$ where y is greater than zero up to 2, x is greater than 0 up to 1.2 and z is greater than 0 up to 0.1; n refers to an infinitely large two-dimensional array, the value of which can vary widely. The carbon fluoride chloride is composed of carbon, fluorine and chlorine where in the carbon chosen is in the form of graphite, coke, needle coke, charcoal, activated carbon and the like. The carbon fluoride chloride may be made by a variety of ways as described in the prior art. For example, carbon can be treated with chlorine monofluoride, ClF, to produce $(C_yF_xCl_z)_n$ or with mixtures of chlorine, $Cl_2$, and fluorine, $F_2$ to produce $(C_yF_xCl_z)_n$. These procedures are described in greater detail in British Pat. No. 759,173 and U.S. Pat. No. 2,786,874, the disclosures of which are hereby incorporated by reference.

The carbon fluoride chloride used as the dry lubricant in accordance to the invention may have a y value of up to 2, preferably between 1 and 2, an x value of greater than 0 and up to 1.2 and a z value of greater than 0 and up to 0.1. Preferably, the y value will vary from about 0.95 to 1.0, the x value will vary from about 0.6 to 1.0, and the z value will vary from about 0.005 to 0.1. Amongst the particular preferred embodiments are those in which y=1, x=1.00 and z=0.005 to 0.01.

DESCRIPTION OF THE PREFERRED EMBODIMENT

The invention provides a novel dry lubricant comprised of a carbon fluoride chloride, $(C_yF_xCl_z)_n$ wherein y is greater than zero and may have a value up to 2, x is greater than 0 up to 1.2 and z is greater than 0 up to 0.1, n refers to an infinitely large two-dimensional array, the value of which can vary widely. The carbon fluoride chloride is composed of carbon, fluorine and chlorine where in the carbon can be chosen in the form of graphite, coke, needle coke, charcoal, activated carbon and the like. Preferably, the carbon fluoride chloride is produced from needle coke. The carbon fluoride chloride employed in the preparation of the novel dry lubricant of the invention maybe prepared by a variety of suitable methods known in the prior art. For example, carbon can be treated with chlorine monofluoride, ClF, to produce $(C_yF_xCl_z)_n$ or with mixtures of chlorine, $Cl_2$, and fluorine, $F_2$ to produce $(C_yF_xCl_z)_n$. Illustrative prior art methods, for example, are those procedures described in British Pat. No. 759,173 and U.S. Pat. No. 2,786,874 which are hereby incorporated by reference.

In the practice of the present invention, the carbon fluoride chloride used as the dry lubricant may have y of a value of greater than zero and up to 2, an x value of greater than 0 and up to 1.2 and a z value of greater than 0 and up to 0.1. In the preferred embodiments of the invention, the y value will vary from about 0.95 to 1.0, the x value will vary from about 0.6 to 1.0, and the z value will vary from about 0.005 to 0.1. Amongst the particular embodiments most preferred are those in which y=about 1, x=about 1.00 and z=from about 0.005 to 0.1.

Of particular advantage in accordance with the present invention is the use of the novel dry lubricant as a durable, long life thin film. This material can be applied to a metal, metal alloy or plastic part in the form of an adhering film by rubbing the material on the surface with a cloth or by suspending the material in an inert liquid, removing the liquid phase to leave a coating on the material. This film requires no other applied lubricant, such as oil or grease.

In extensive comparative tests of the dry lubricant of the present invention, the results of which are summarized in Table I, we have found that carbon fluoride chloride of the invention provides a more durable, longer life film than $MoS_2$, graphite, and carbon fluoride. Specifically, on a comparison with carbon fluoride the dry lubricant carbon fluoride chloride of the invention proved to be 30 times greater than carbon fluoride, 4 times greater than graphite and almost 20 times better than $MoS_2$.

TABLE I

| Lubricant | Kilocycles |
|---|---|
| $MoS_2$ | .6 |
| Graphite | 2.5 |
| Accufluor - $CF_x$ | .4 |
| $CF_xCl_y$ | 11.7 |

An advantageous ultilization of the novel dry carbon fluoride chloride lubricants of the invention in the provision of a self-lubricating coating with increased PV value on metals or other substrates. The term "self-lubricating" designates a working surface that has an anti-friction characteristic sufficient to enable the working surface to work satisfactorily in the absence of an applied lubricant, such as oil or grease. The term "PV" value is an empirical value obtained by multiplying the load P on the coating, expressed in mass per unit area over the project area by the velocity in distance per unit time. It will be understood that the larger the PV value the better the coating material. This is accomplished by dispersing the novel lubricant in a suitable synthetic resin. Typical suitable synthetic resins include phenolic resins, urea resins, polytetrafluoroethane resins, epoxy resins, divinylbenzene resins, furan resins and trimethylbenzene resins. The proportion of novel dry lubricant to synthetic resin is about 90:10 to 10:90 by weight. The dispersion may also include an admixture of at least one conventional lubricant material such as $MoS_2$, graphite, polytetrafluoroethylene or carbon fluoride. The proportion of conventional lubricating material to the novel dry lubricant powder being about 99.5:0.05 to 5:95 by weight, the proportion of the mixture to synthetic resin being about 90:10 to 10:90 by weight.

In accordance with the present invention, the proportion of the conventional lubricating material to carbon fluoride chloride powder is of the order of about 99.5:0.05 to 5:95 by weight, preferably 70:30 to 30:70 by weight. Although the carbon fluoride chloride shows good properties even in a small amount, the PV value is lowered when the amount of carbon fluoride chloride is less than about 0.5 part by weight per 99.5 parts by weight of the conventional lubricating material and the effect due to carbon fluoride chloride is not exhibited. Further, when the amount of carbon fluoride chloride is larger than 95 parts by weight per 5 parts by the conventional lubricating material, the friction co-efficient becomes larger than that of the conventional lubricating material alone and results in an economical disadvantage.

Also, in the present invention, the proportion of the resin to carbon fluoride chloride or lubrication material mixture ranges from about 90:10 to 10:90 by weight, preferably 60:40 to 40:60 by weight. When the amount of the resin is smaller than about 10 parts by weight per 90 parts by weight of lubricating material, the surface of the resulting film is rough and the lubricating material is removable by rubbing. Also, the adhesion of the film to the substrate is weak. When the amount of resin is higher than 90 parts by weight per 10 parts by weight of lubricating material, it is found that the resin completely covers the lubricating material particles, resulting in a decrease in PV value.

The following Examples are presented in order that the invention may be more fully understood. The details set forth are primarily for purposes of illustration and any specific enumeration of ingredients or proportions or conditions should not be interpreted as a limitation except as expressed in the appended claims.

EXAMPLE 1

Carbon fluoride chloride is burnished on stainless steel disks in such a way as to obtain a film of uniform thickness of 5 μm. The lubricating ability was determined by measuring the number of kilocycles required to reach a friction coefficient of 0.3 using the standard sphere on plane apparatus. The results of the test are presented in Table I.

EXAMPLE 2

Molybdenum disulfide is burnished on stainless steel disks in such a way as to obtain a film of uniform thickness of 5 μm. The lubricating ability was determined by measuring the number of kilocycles required to reach a friction coefficient of 0.3 using the standard sphere on plane apparatus. The results of the test are presented in Table I.

EXAMPLE 3

Graphite is burnished on stainless steel disks in such a way as to obtain a film of uniform thickness of 5 μm. The lubricating ability was determined by measuring the number of kilocycles required to reach a friction coefficient of 0.3 using the standard sphere on plane apparatus. The results of the test are presented in Table I.

EXAMPLE 4

Carbon fluoride—Accufluor—$CF_x$, available from Allied Corporation is burnished on stainless steel disks in such a way as to obtain a film of uniform thickness of 5 μm. The lubricating ability was determined by measuring the number of kilocycles required to reach a friction coefficient of 0.3 using the standard sphere on plane apparatus. The results of the test are presented in Table I.

The invention having thus been described, that which is desired to be secured by Letters Patent is set forth in the claims which follow.

What is claimed is:

1. A long lasting spreadable dry lubricant composition comprising a carbon fluoride chloride of the formula:

$$(C_yF_xCl_z)_n$$

wherein y is greater than zero and up to 2, x is greater than zero and up to 1.2 and z is greater than zero and up to 0.1, and n refers to a two-dimensional array with an infinitely large value homogeneously dispersed in a synthetic resin in a proportion of lubricant to resin of from about 90:10 to about 10:90 parts by weight respectively.

2. The lubricant composition of claim 1 containing in admixture with said carbon fluoride chloride lubricant, a different lubricant in relative proportions by weight respectively of from 0.05:99.5 to 95:5.

3. The composition of claim 1 wherein the synthetic resin is selected from the group consisting of phenolic resins, urea formaldehyde resins, polytetrafluoroethylene resins, epoxy resins, divinylbenzene resins, furan resins and trimethylbenzene resins.

4. The composition of claim 3 wherein the synthetic resin is a phenol formaldehyde resin.

5. A process for lubricating a substrate which comprises applying to said substrate a coating of a dry lubricant comprising a carbon fluoride chloride of the formula:

$$(C_yF_xCl_z)_n$$

wherein y is greater than zero and up to 2, x is greater than zero and up to 1.2 and z is greater than zero and up to 0.1, and n refers to a two-dimensional array with an infinitely large value.

6. A process according to claim 5 wherein the carbon of the formula is derived from needle coke.

7. A process according to claim 5 wherein y has a value of from about 0.95 to 1.0, x has a value of from about 0.6 to 1.0 and z has a value of from about 0.005 to 0.1.

8. A process according to claim 5 wherein y and x have a value of about 1 and z has a value of about 0.005.

9. A process according to claim 5 wherein the dry lubricant of claim 1 is homogeneously dispersed in a synthetic resin in the proportion of lubricant to resin of from about 90:10 to about 10:90 parts by weight respectively.

10. A process according to claim 9 wherein the dry lubricant composition contains in admixture with said carbon fluoride chloride lubricant, a different lubricant in relative proportions by weight respectively of from 0.5:99.5 to 95:5.

11. A process according to claim 9 wherein the synthetic resin is selected from the group consisting of phenolic resins, urea formaldehyde resins, polytetrafluoroethylene resins, epoxy resins, divinylbenzene resins, furan resins and trimethylbenzene resins.

* * * * *

UNITED STATES PATENT AND TRADEMARK OFFICE

CERTIFICATE OF CORRECTION

PATENT NO. : 4,770,797

DATED : September 13, 1988

INVENTOR(S) : A. V. Syracuse et al.

It is certified that error appears in the above-identified patent and that said Letters Patent are hereby corrected as shown below:

Claim 10, line 5 delete "0.5:99.5"; substitute therefor

-- 0.05:99.5 --.

Signed and Sealed this

Twenty-fourth Day of January, 1989

*Attest:*

DONALD J. QUIGG

*Attesting Officer*

*Commissioner of Patents and Trademarks*